US006142859A

United States Patent [19]

Ross et al.

[11] Patent Number: 6,142,859

[45] Date of Patent: Nov. 7, 2000

[54] POLISHING APPARATUS

[75] Inventors: Clifford Ross, Happy Valley; Michael Christoff, Kowloon, both of The Hong Kong Special Administrative Region of the People's Republic of China

[73] Assignee: Always Sunshine Limited, Hong Kong, The Hong Kong Special Administrative Region of the People's Republic of China

[21] Appl. No.: 09/176,669

[22] Filed: Oct. 21, 1998

[51] Int. Cl.[7] ..... B24B 21/18; B24B 33/00; B24B 47/26; B24B 55/00

[52] U.S. Cl. ..... 451/443; 451/444; 451/269; 451/268; 451/271

[58] Field of Search ..... 451/443, 444, 451/56, 41, 70, 72, 259, 268, 269, 270, 271, 262; 15/21.1, 77, 88.2

[56] References Cited

U.S. PATENT DOCUMENTS

| | | | |
|---|---|---|---|
| 3,753,269 | 8/1973 | Budman | 451/444 |
| 5,616,069 | 4/1997 | Walker et al. | 451/56 |

FOREIGN PATENT DOCUMENTS

| | | | |
|---|---|---|---|
| 402065967 | 3/1990 | Japan | 451/288 |
| 404035870 | 2/1992 | Japan | 451/444 |
| 404310364 | 11/1992 | Japan | 451/143 |
| 406055434 | 3/1994 | Japan | 51/41 |

*Primary Examiner*—Derris Holt Banks
*Attorney, Agent, or Firm*—Jackson Walker L.L.P.

[57] ABSTRACT

A bristle carrier for leaning a polishing apparatus comprises a number of radial slots into which sub-frames carrying bristles can be releasably mounted. The bristle carrier is used in place of a component carrier used during normal polishing, and is driven in planetary fashion over clothed polishing surfaces to clean those surfaces. The same carrier can be used, even when the bristles have to be replaced due to wear, by replacing the sub-frames having new bristles.

3 Claims, 2 Drawing Sheets

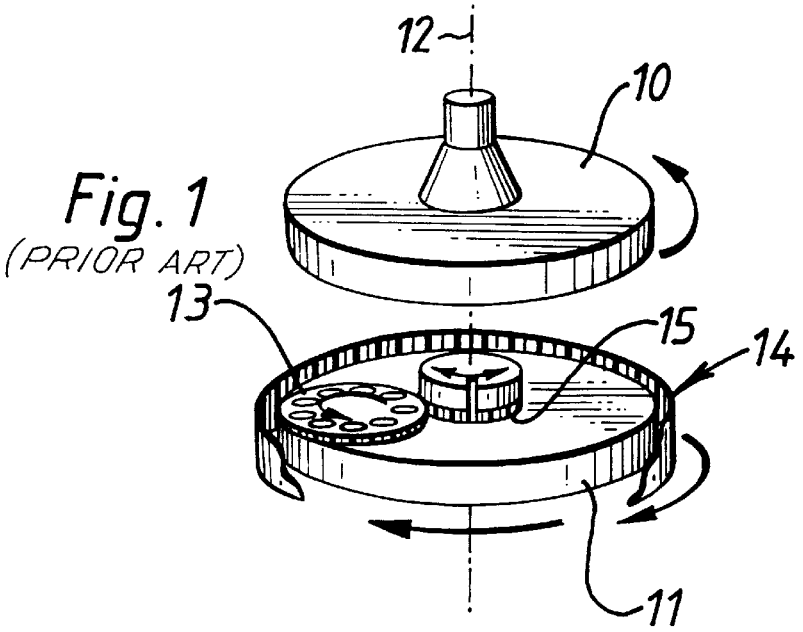
Fig. 1
(PRIOR ART)
Fig. 2
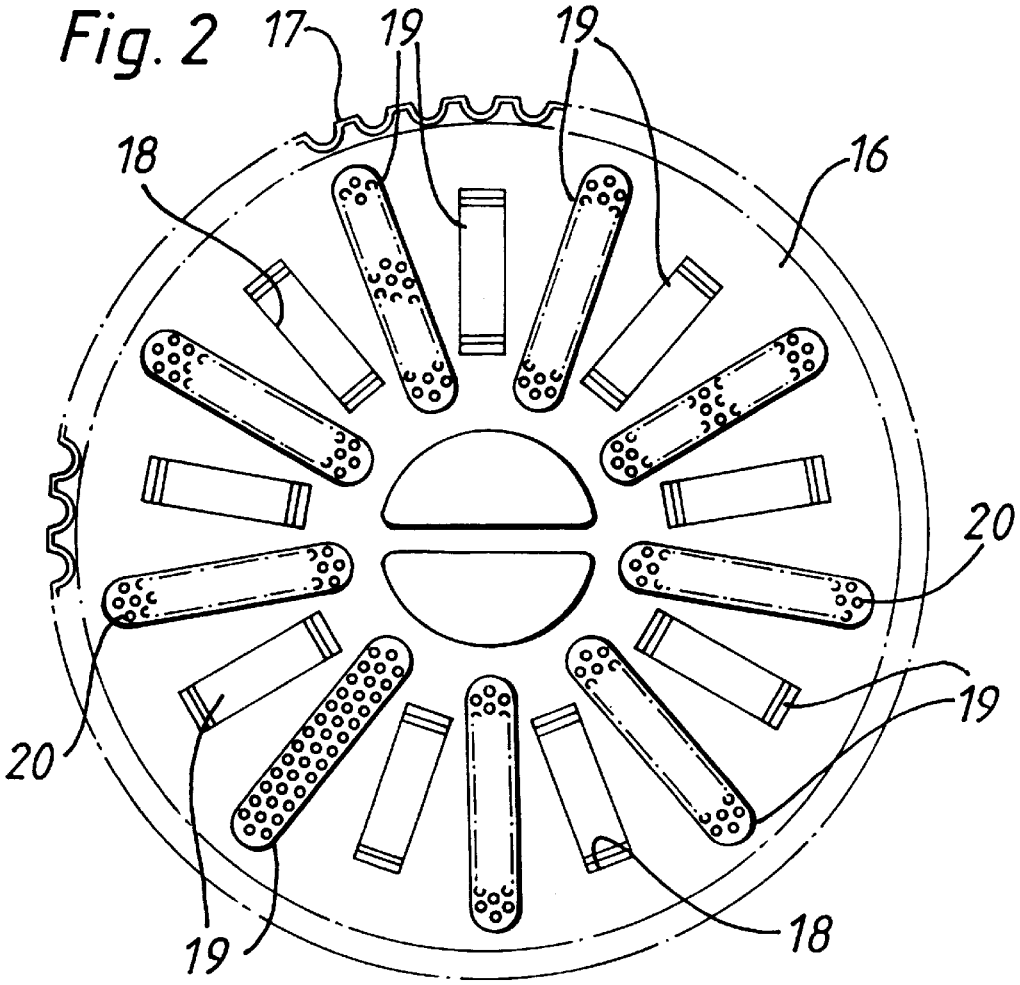

POLISHING APPARATUS

BACKGROUND OF THE INVENTION

1. Field of the Invention

The invention relates to polishing apparatus.

2. Description of Prior Art

The invention relates more particularly to polishing (and lapping) apparatus particularly for finishing planar surface of various materials such as quartz, ceramics, ferrite, piezo-electric elements semi-conductor wafers, oxide wafers, carbon, metals and super-hard compounds. Typically, the polishing apparatus comprises a lower circular flat disc and an upper opposing circular flat disc that is relatively rotated about a common axis. The opposing surfaces are covered or coated with cloth or other similar material and the components that are to be polished supported in a carrier that is arranged to be rotated in planetary fashion by the relative rotation of the discs. Such an arrangement is well-known.

During polishing, particles removed from the surfaces of the components and residue to polishing pastes or other fluids is deposited on to the cloth surfaces of the discs. It is known to provide a bristled carrier, to replace the component carrier, that serves to clean the polishing surface of the discs. At present the bristled carrier has a plurality of clumps of bristles protruding beyond each its surfaces, the top and bottom surfaces, of the carrier disposed in a spiral array. As the polishing apparatus is operated, the bristled carrier is driven in planetary fashion to brush-clean the clothed surfaces of the discs. The bristles are permanently attached to the carrier and when the bristles wear down or become otherwise non-serviceable, the bristled carrier has to be discarded in toto. This makes replacing the carriers relatively expensive and, as it is sometimes desirable to have different cleaning bristles for different applications, (i.e. harder/stronger bristles are sometimes required), this means that each of the present bristled carriers have minimum versatility.

SUMMARY OF THE INVENTION

It is an object of the invention to overcome or at least reduce this problem.

According to the invention there is provided a bristle carrier for a polishing apparatus having an upper and lower polishing disc that are arranged to be relatively rotated about a common central axis and to normally drive therebetween a component carrier in planetary fashion for polishing the components, in which the bristle carrier has a geared peripheral edge and radial slots, each slot being arranged to receive an elongate sub-frame with a central longitudinal axis and having mounted thereto bristles separated and distributed generally along the longitudinal axis, and in which some of sub-frames are mounted to an upper surface of the bristle holder and others of the sub-frames are mounted to a lower surface of the bristle holder.

The sub-frames may be held in the radial slots by integrally formed spring clips.

BRIEF DESCRIPTION OF THE DRAWINGS

A polishing apparatus bristle carrier according to the invention will now be described by way of example with reference to the accompanying drawings in which:

FIG. 1 is an isometric diagrammatic view of a known polishing apparatus;

FIG. 2 is a plan view of the bristle carrier of the present invention;

DESCRIPTION OF THE PREFERRED EMBODIMENTS

Figure 3:
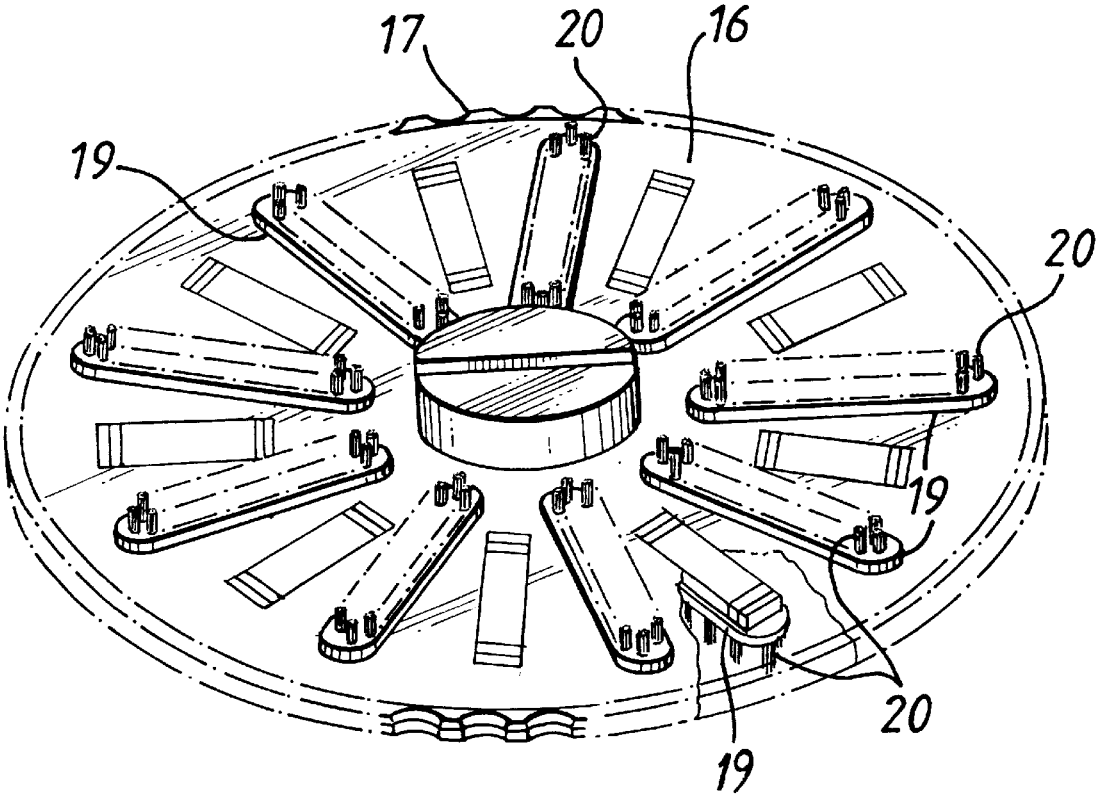
FIG. 3 is a top isometric view of the carrier showing bristles on the top and bottom sides.

Referring to the drawings, a polishing apparatus comprises an upper circular disc 10 and a lower circular disc 11. This discs are relatively rotatable about a common axis 12. A component carrier 13 has a geared peripheral edge that is engaged by an internal gear 14 and a sun gear 15. When the polishing apparatus is operated, the carrier 13 is moved in planetary fashion so that planar surfaces of components in the carrier are polished by clothed opposing surfaces of the upper and lower discs. Such a polishing apparatus are well-known.

In FIG. 2, a plastic bristle carrier base 16A has a geared peripheral edge 17 and a plurality of radical slots 18 that each receive an elongate frame member 19. Each frame carries one or more arrays of bristles 20, in this embodiment three arrays, that are separated and extend generally along or parallel to a central longitudinal axis of each frame. That is to say, the arrays of bristles generally lie along a respective radius of the carrier 16. Half the slots 18 have frame members with their bristles "facing" upwards and the other have bristles "facing" downwards (and not visible in FIG. 2), so that in the assembled bristle carrier, the bristles face upwards and downwards in a symmetrical manner.

In FIG. 3, the upper and lower surfaces of the bristle carrier are shown with slots for the downward facing sub-frames shown on the lower surface of the carrier.

Figure 4:
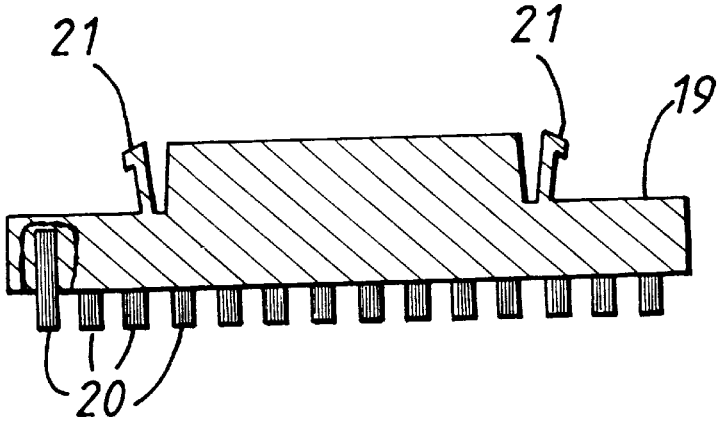
FIG. 4 is dual sectioned side view of a sub-frame of the carrier.

In FIG. 4, two integrally formed clips 21 are provided towards each end of the sub-frame 19 that releasably hold the sub-frame in a respective radial slot 18 of the carrier 16.

The bristle carriers of the invention can therefore be re-used because when the bristles wear down or become otherwise unserviceable, the sub-frames 19 can be replaced with sub-frames having new bristles. Also, the same carrier 16 can be used with bristles having different characteristics, when desired, by simply replacing the sub-frames with sub-frames having suitably different types or characteristic bristles.

It will also be noted that the arrays of bristles 20 are positioned in use to extend in use along respective radii of the carrier 16. In the prior art, the bristles are supported in concentric arrays. The radial disposition has been found to provide more even and satisfactory cleaning of the polishing cloths or pad of the discs 10 and 11.

We claim:

1. A polishing apparatus comprising:

an upper and lower polishing disc arranged to relatively rotate about a common central axis and to normally planetarily drive therebetween a component carrier for polishing components in said component carrier; and a bristle carrier comprising:

a carrier base having a geared peripheral edge and a plurality of radial slots, each said slot arranged to receive an elongate sub-frame having a central longitudinal axis, each of said sub-frames having bristles separated and distributed generally along said longitudinal axis;

a first portion of said sub-frames mounted to an upper surface of said bristle carrier; and a second portion of said sub-frames mounted to a lower surface of said bristle carrier.

2. A polishing apparatus according to claim 1, wherein said sub-frames are releasably held in said radial slots.

3. A polishing apparatus according to claim 2, wherein said sub-frames are held in said radial slots by integrally formed spring clips.

* * * * *